US007895686B1

(12) United States Patent
Chen

(10) Patent No.: US 7,895,686 B1
(45) Date of Patent: Mar. 1, 2011

(54) PORTABLE FOLDING HAMMOCK

(76) Inventor: Zhaosheng Chen, El Monte, CA (US)

( * ) Notice: Subject to any disclaimer, the term of this patent is extended or adjusted under 35 U.S.C. 154(b) by 0 days.

(21) Appl. No.: 12/862,941

(22) Filed: Aug. 25, 2010

Related U.S. Application Data

(63) Continuation-in-part of application No. 12/536,431, filed on Aug. 5, 2009, now abandoned.

(51) Int. Cl.
*A45F 3/22* (2006.01)

(52) U.S. Cl. ..... 5/127; 5/120

(58) Field of Classification Search ..... 5/120–123, 5/127–130, 182
See application file for complete search history.

(56) References Cited

U.S. PATENT DOCUMENTS 925,044 A * 6/1909 Schultz ..... 5/130
2,581,623 A * 1/1952 Benjamin ..... 5/129
6,966,084 B2 * 11/2005 Le Gette et al. ..... 5/129
7,089,610 B2 * 8/2006 Zhong ..... 5/122
7,395,561 B2 * 7/2008 Le Gette et al. ..... 5/127
7,406,726 B2 * 8/2008 Deng ..... 5/127
7,441,287 B2 * 10/2008 Zheng ..... 5/129

* cited by examiner

*Primary Examiner*—Michael Trettel
(74) *Attorney, Agent, or Firm*—Clement Cheng

(57) ABSTRACT

A folding hammock has a frame formed of seven segments including elongated members connected in swivel connection to each other. The frame includes a front segment, a rear segment, a middle segment formed between the front segment and the rear segment and a pair of right segments and a pair of left segments. The pair of right segments and the pair of left segments join the front segment, the rear segment and the middle segment together. The pair of right segments includes a rear right segment and a rear left segment. The pair of left segments includes a rear left segment and a front left segment. Each segment is made of a crossing scissor structure having 'x' shaped configuration. A pair of front inside connection members is attached to a pair of front corner posts. The pair of front corner posts defines the bounds of the front segment.

8 Claims, 3 Drawing Sheets

PORTABLE FOLDING HAMMOCK

This application is a continuation in part of non-provisional U.S. patent application Ser. No. 12/536,431 currently in art unit 3673 which was filed Aug. 5, 2009 now abandoned Zhaosheng Chen entitled folding hammock, the disclosure of which is incorporated herein by reference.

FIELD OF THE INVENTION

The present invention is in the field of portable folding hammocks.

DISCUSSION OF RELATED ART

A variety of portable folding hammocks have been created. For example, in U.S. Pat. No. 337,792 to Rudd and Manning, issued Mar. 9, 1886 the disclosure of which is incorporated herein by reference, a hammock comprises a portable arrangement of cords and ropes in a canopy suspending frame. A device comprising a collapsible, self-supporting hammock assembly with ground engaging stabilizers is shown in U.S. Pat. No. 5,983,422 to Bayless, issued Nov. 16, 1999, the disclosure of which is incorporated herein by reference.

For example, in U.S. Pat. No. 342,841 to Campanello, issued Jan. 4, 1994 the disclosure of which is incorporated herein by reference, the folding portable hammock comprises a support frame with attached hammock assembly. The ornamental design for a foldable hammock is shown in U.S. Pat. No. D565,861 to Erickson, issued Apr. 8, 2008 the disclosure of which is incorporated herein by reference.

A folding hammock comprises a rectangular top frame and similar heavier bottom frame, held together by fabric forming the sides as shown in U.S. Pat. No. 1,240,499 to Sisbower and Pittoni, issued Sep. 18, 1917 the disclosure of which is incorporated herein by reference. For example, in U.S. Pat. No. 7,089,610 to Zhong, issued Aug. 15, 2006, the disclosure of which is incorporated herein by reference, a portable collapsible hammock has a suspended body support surface and frame consisting of inclined upright arms connected by x-scissor linkages. Also for example, in U.S. Pat. No. 408,166 to Bayless, issued Apr. 20, 1999, the disclosure of which is incorporated herein by reference, a collapsible hammock comprises a fabric surface suspended over a collapsible frame.

SUMMARY OF THE INVENTION

A folding hammock has a frame formed of seven segments including elongated members connected in swivel connection to each other. The frame includes a front segment, a rear segment, a middle segment formed between the front segment and the rear segment and a pair of right segments and a pair of left segments. The pair of right segments and the pair of left segments join the front segment, the rear segment and the middle segment together. The pair of right segments includes a rear right segment and a rear left segment. The pair of left segments includes a rear left segment and a front left segment. Each segment is made of a crossing scissor structure having 'x' shaped configuration. A pair of front inside connection members is attached to a pair of front corner posts. The pair of front corner posts defines the bounds of the front segment.

A front left inside connection member is connected to the front left segment. Eight front right inside connection member is connected to the front right segment. A pair of rear inside connection members is attached to the pair of rear corner posts. The pair of rear corner posts defines the bounds of the rear segment. A rear left inside connection member is connected to the rear left segment. A rear right connection member is connected to the rear right segment. A pair of feet is mounted to a front end of the folding hammock.

The folding hammock may have a canopy mounted on canopy extension members extending from the pair of front corner posts and the pair of rear corner posts. The canopy extension members are in telescopic connection with the pair of front corner posts and the pair of rear corner posts and they may be pulled out of their retracted positions my hand.

Preferably, a line is mounted on line clips, wherein the line clips are mounted on the pair of front corner posts and the pair of rear corner posts. One line clip hook can be installed on each of the pair of front corner posts and the pair of rear corner posts. Each of the line clips may terminate with a line clip carabiner. The pair of front inside connection members and the pair of rear inside connection members are oriented to swivel upward from an inside connection member bottom clips that detach from a bottom clip connection area. A canopy can be mounted on canopy extension members extending from the pair of front corner posts and the pair of rear corner posts. The canopy extension members are in telescopic connection with the pair of front corner posts and the pair of rear corner posts.

A pair of rear inside connection members are attached to a pair of rear corner posts. The pair of rear corner posts defines the bounds of the rear segment. A rear left inside connection member is connected to the rear left segment. A rear right connection member is connected to the rear right segment. Inside connection joints formed on inside connection member top brackets may provide a deployed angle of side members and the inside connection members that increase beyond 180° when the folding hammock folds into a folded position.

Figure 1:
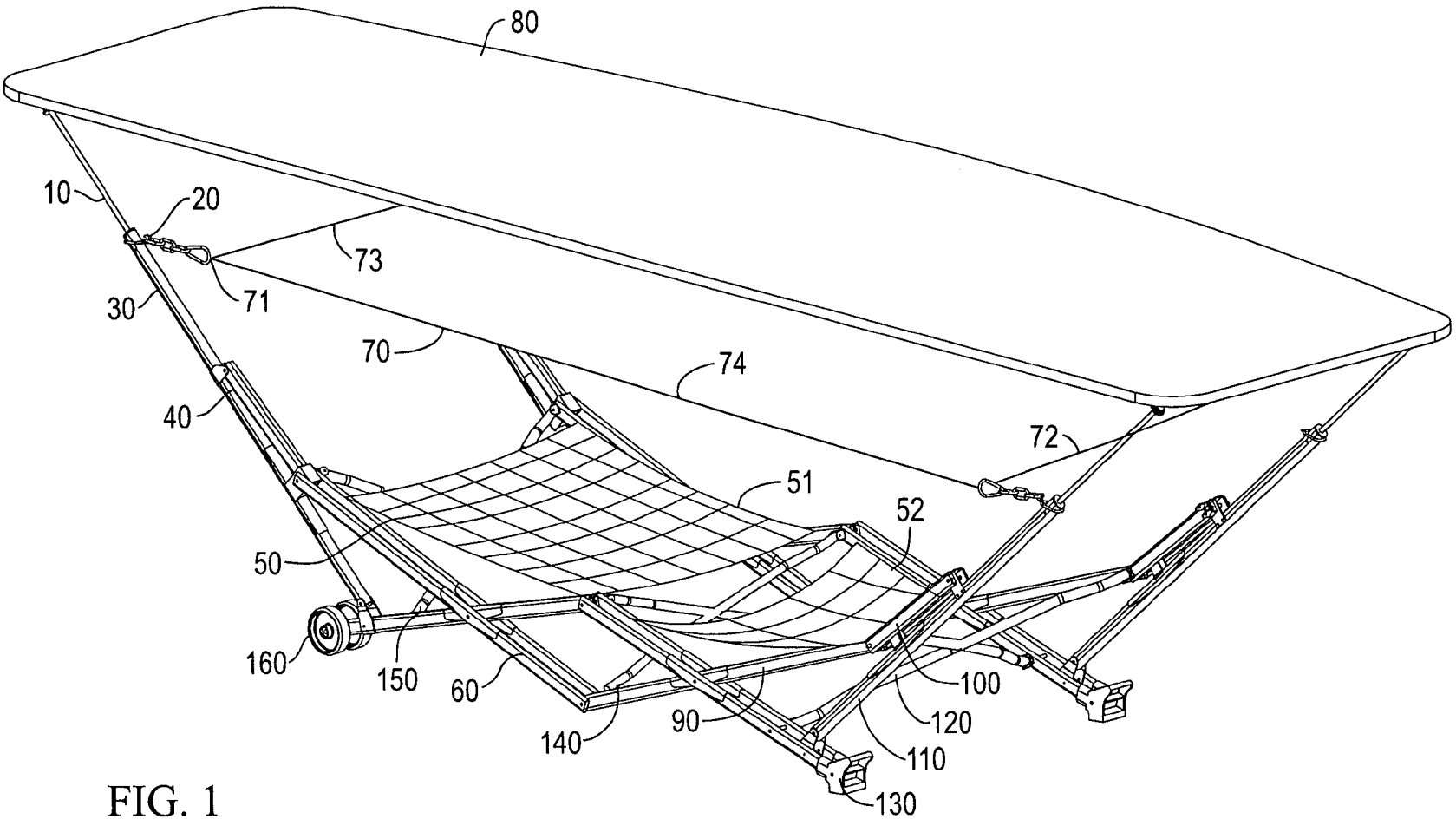
FIG. 1 is a perspective view of the hammock in the deployed position.
Figure 2:
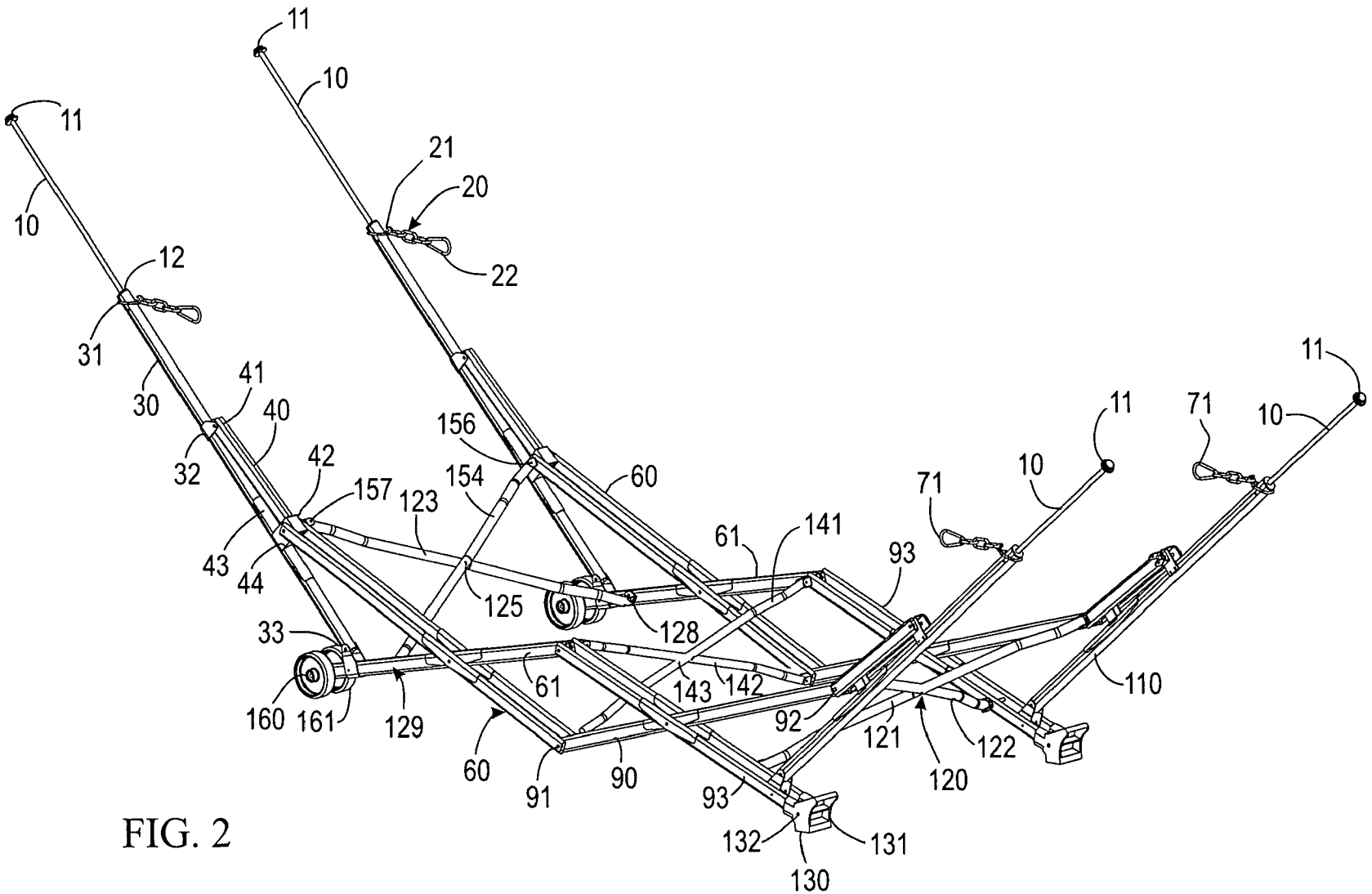
FIG. 2 is a perspective view of the hammock without the canopy and line.
Figure 3:
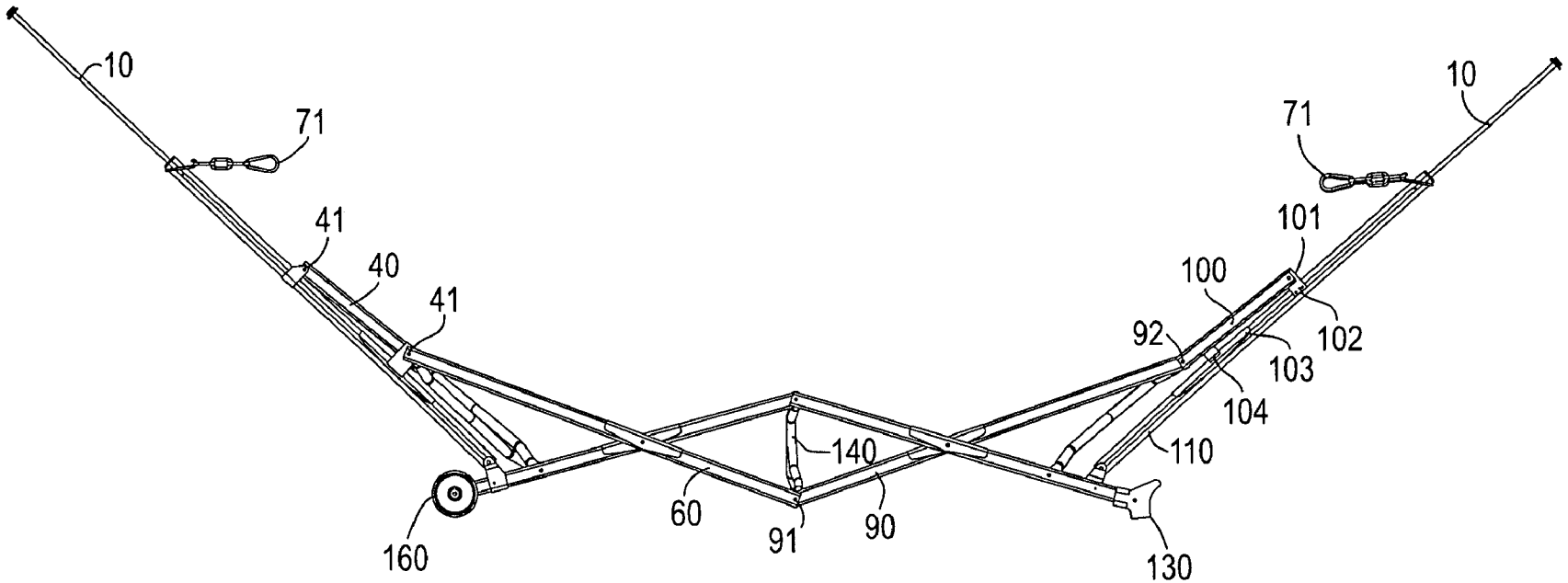
FIG. 3 is a side view of the hammock.

The following call out list of elements may be useful as a guide in referencing the elements of the drawings.

10 Canopy Extension Member
12 Canopy Extension Member Opening
20 Line Clip
21 Line Clip Hook
22 Line Clip Carabiner
30 Rear Corner Post
31 Clip Connection
32 Rear Inside Connection Member Top Bracket
33 Corner Post Connection
40 Rear Inside Connection Member
41 Rear Inside Top Connection Joint
42 Rear Inside Bottom Connection Joint
43 Rear Bottom Clip Connection Area
44 Rear Inside Connection Member Bottom Clip
50 Hammock Bed
60 Side Rear Double Member
61 Side Rear Single-Member
51 Rear Hammock Bed Section
52 Front Hammock Bed Section
71 Line Corner
72 Line Front Edge
73 Line Rear Edge

74 Line Side Edge
80 Canopy
90 Side Front Single Member
91 Side Bottom Middle Connection
93 Side Front Double Member
92 Front Inside Bottom Connection Joint
100 Front Inside Connection Member
101 Front Inside Top Connection Joint
102 Front Inside Connection Member Top Bracket
103 Front Bottom Clip Connection Area
104 Front Inside Connection Member Bottom Clip
110 Front Corner Post
120 Front Segment
121 Front Segment First Member
122 Front Segment Second Member
150 Rear Segment
123 Rear Segment First Member
125 Rear Segment Middle Joint
154 Rear Segment Second Member
128 Lower Right Rear Corner Connection
129 Lower Left Rear Corner Connection
137 Upper Left Rear Corner Connection
156 Upper Right Rear Corner Connection
140 Middle Segment
141 First Middle Member
142 Second Middle Member
143 Middle Middle Joint
130 Foot
131 Foot Concave
132 Foot Connection
160 Wheel Assembly
161 Wheel Axle

BRIEF DESCRIPTION OF THE PREFERRED EMBODIMENT

The hammock described can fold up into a bundle of sticks and covered with a bag, or wheeled around for easy transportation. The plurality of elongated members formed as sticks provide structure to the folding hammock. The hammock has a rectangular figure eight structure made of folding members. The folding members comprise seven separate segments analogous to a seven segment display. The seven segments include a front segment toward the feet of the hammock, a rear segment toward the wheels of the hammock, a middle segment between the front segment and the rear segment, and a pair of right segments and a pair of left segments. The pair of right segments include a right rear segment and a right front segment. The pair of left segments include a left rear segment and a left front segment. Each segment is made of a crossing scissor structure where the members are in pin joint swivel connection having 'x' shaped configuration. Additionally, a pair of front inside connection members and a pair of rear inside connection members are connected to each of the pair of right segments and the pair of left segments.

The canopy extension member 10 extends from a corner post such as rear corner post 30. A line clip 20 provides a clip connection 31 with a line that extends above the user. The line may be formed in the shape of a sheet such as a fabric shade. The canopy extension member has telescopic extension from a corner post such as rear corner post 30. The line clip 20 can be mounted on a line clip hook 21 and terminate with a line clip carabiner 22.

When folding, the inside connection members swivel on a top bracket such as rear inside connection member top bracket 32. The rear inside connection member 40 swivels upward and the rear inside connection member bottom clip 44 detaches from the rear bottom clip connection area 43. The rear inside top connection joint 41 is formed on the rear inside connection member top bracket 32. The rear inside bottom connecting joint 42 swivels in relation to the side rear double member 60. The deployed angle of the side rear double member 60 and the rear inside connection member 40 increases beyond 180° when the folding hammock is folding into a folded position. The rear inside connection member bottom clip 44 engages with the rear bottom clip connection area 43 in a snug fit and can be attached and reattached. The rear bottom clip connection area 43 can be formed as a sheet or sleeve disposed over the rear corner post 30. The side rear double member 60 is formed of a pair of members parallel to each other and sandwiching the rear inside bottom connection joint 42 as well as sandwiching the side front single-member 90. Also sandwiched is the side rear single-member 61 so that in combination the members hold up the hammock bed 50 which is formed and a pair of sections, namely a rear hammock bed section 51 and a front hammock bed section 52.

The corner post connection 33 is in swivel connection with the corner post 30. The lower portion of the foot 130 may include a foot concave 131 for gripping the ground. The foot is preferably in swivel connection on a foot connection 132.

The line held on the line clip 20 forms four corners in a rectangular profile which can be filled in with a net such as mosquito netting, or a shade. The line has a line corner, and forms a line front edge 72, a line rear edge 73 and a line side edge 74. The canopy 80 is placed over the line. The line can allow a user to attach additional objects to the hammock such as camping equipment like lights or a compass.

The front inside connection member 100 is in similar configuration to the rear inside connection member 40 in that it is connected at a front inside top connection joint 101 to the front corner post 110 just like the rear inside connection member 40 was connected at a rear inside top connection joint to a rear corner post. The front inside connection member 100 also swivels upward during folding on the top connection joint 101 so that it rotates on front inside bottom connection joint 92 and rotates on the front inside top connection joint 101. When the front inside connection member 100 rotates upward, it releases the front inside connection member bottom clip 104 from the front corner post 110. Analogous to the rear construction, the front inside top connection joint 101 is connected on the front inside connection member top bracket 102. The front inside connection member bottom clip 104 is released and reattached to the front bottom clip connection area 103.

The front segment 120 includes a front segment first member 121 and a front segment second member 122 mounted in a swivel connection. The segments are not necessarily attached in a coplanar fashion, but can be offset or bent for better folding. Similarly, the rear segment includes a rear segment first member 123, a rear segment middle joint 125 connecting a rear segment second member 154. The rear segment is connected at its bottom portion to the side rear single-members 61 at a lower right rear corner connection 128 and a lower left rear corner connection 129. The rear segment is connected at its top portion to the upper left rear corner connection 137 and the upper right rear corner connection 156. The upper left rear corner connection 137 and the upper right rear corner connection 156 connect to the inside bottom connection joint 42 or alternatively to the corner post.

The middle segment 140 includes a first middle member 141 and a second middle member 142 connected at a middle middle joint 143. At each of the four corners of the middle segment 140, a bracket connects to the middle connections which include the side bottom middle connection 91, as well as the side top middle connections. The entire structure thus is foldable from a deployed position into a collapsed position where the sticklike rod members are substantially all parallel to each other.

The invention claimed is:

1. A folding hammock comprising:

a. a frame formed of seven segments comprising a plurality of elongated members connected in swivel connection to each other, wherein the frame includes a front segment, a rear segment, a middle segment formed between the front segment and the rear segment and a pair of right segments and a pair of left segments, wherein the pair of right segments and the pair of left segments join the front segment, the rear segment and the middle segment together, wherein the pair of right segments includes a rear right segment and a rear left segment and wherein the pair of left segments include a rear left segment and a front left segment, wherein each segment is made of a crossing scissor structure having 'x' shaped configuration;

b. a pair of front inside connection members attached to a pair of front corner posts, wherein the pair of front corner posts defines the bounds of the front segment; a front left inside connection member connected to the front left segment; a front right inside connection member connected to the front right segment;

c. a pair of rear inside connection members attached to a pair of rear corner posts, wherein the pair of rear corner posts defines the bounds of the rear segment; a rear left inside connection member connected to the rear left segment; a rear right connection member connected to the rear right segment; and d. a pair of feet mounted to a front end of the folding hammock.

2. The folding hammock of claim 1, further comprising: a canopy mounted on canopy extension members extending from the pair of front corner posts and the pair of rear corner posts, wherein the canopy extension members are in telescopic connection with the pair of front corner posts and the pair of rear corner posts.

3. The folding hammock of claim 1, further comprising: a line mounted on line clips, wherein the line clips are mounted on the pair of front corner posts and the pair of rear corner posts.

4. The folding hammock of claim 3, further comprising: one line clip hook on each of the pair of front corner posts and the pair of rear corner posts, wherein each of the line clips terminate with a line clip carabiner.

5. The folding hammock of claim 1, wherein the pair of front inside connection members and the pair of rear inside connection members are oriented to swivel upward from inside connection member bottom clips that detach from a bottom clip connection area.

6. The folding hammock of claim 5, further comprising: a canopy mounted on canopy extension members extending from the pair of front corner posts and the pair of rear corner posts, wherein the canopy extension members are in telescopic connection with the pair of front corner posts and the pair of rear corner posts.

7. The folding hammock of claim 5, further comprising: a line mounted on line clips, wherein the line clips are mounted on the pair of front corner posts and the pair of rear corner posts.

8. The folding hammock of claim 7, further comprising: one line clip hook on each of the pair of front corner posts and the pair of rear corner posts, wherein each of the line clips terminate with a line clip carabiner.

* * * * *